United States Patent [19]

Tsubata et al.

[11] Patent Number: 4,617,983

[45] Date of Patent: Oct. 21, 1986

[54] METHOD AND APPARATUS FOR CONTINUOUSLY MANUFACTURING METAL FILAMENTS

[75] Inventors: Hisayasu Tsubata, Uji; Shoji Tamamura, Nara; Akira Tanimura, Kyoto, all of Japan

[73] Assignee: Unitika Ltd., Japan

[21] Appl. No.: 734,789

[22] Filed: May 16, 1985

[30] Foreign Application Priority Data

May 21, 1984 [JP] Japan ..... 59-103315

[51] Int. Cl.[4] ..... B22D 11/06

[52] U.S. Cl. ..... 164/463; 164/413; 164/423; 164/483

[58] Field of Search ..... 164/150, 154, 155, 423, 164/427, 451, 452, 453, 463, 479, 483, 413, 454

[56] References Cited

U.S. PATENT DOCUMENTS

| | | | |
|---|---|---|---|
| 3,856,513 | 12/1974 | Chen et al. | 164/463 |
| 3,881,542 | 5/1975 | Polk et al. | 164/423 |
| 4,523,626 | 6/1985 | Masumoto et al. | 164/463 |
| 4,527,614 | 7/1985 | Masumoto et al. | 164/463 |

FOREIGN PATENT DOCUMENTS

| | | | |
|---|---|---|---|
| 57-109549 | 7/1982 | Japan | 164/423 |

*Primary Examiner*—Nicholas P. Godici
*Assistant Examiner*—Richard K. Seidel
*Attorney, Agent, or Firm*—Barnes, Kisselle, Raisch, Choate, Whittemore & Hulbert

[57] ABSTRACT

Molten metal 23 is streamed as a jet 25 from a nozzle 17 toward a cooling liquid layer 24 formed by the centrifugal force of a rotary drum 1 in rotation. The jet 25 is quenched and solidified to form a metal filament. The front end portion of the metal filament rides on a pickup 13*a*. The pickup 13*a* rotates synchronously with the rotary drum 1 and, during this synchronous rotation, it is displaced radially inwardly of the rotary drum. The front end portion of the metal filament is attracted by magnetic force to a magnet roller 19 from the pickup 13*a*. A following portion of the metal filament are wound and held on the magnet roller 19 in rotation. Subsequently, the magnet roller 19 moves toward a winder located outside the drum 1 to deliver the metal filament to the winder so that the metal filament is wound on the winder directly from the rotating drum.

12 Claims, 8 Drawing Figures

METHOD AND APPARATUS FOR CONTINUOUSLY MANUFACTURING METAL FILAMENTS

The present invention relates to a method and apparatus for continuously manufacturing metal filaments.

Recently, for the purpose of manufacturing metal filaments having a circular cross section from molten metal, a so-called rotating liquid spinning method has been proposed, and development of techniques in this field has rapidly been in progress. In a spinning method disclosed in Japanese Published Unexamined Patent Application No. 56-165016, for example, a cooling liquid layer is formed on the inner periphery of a rotating cylindrical drum by centrifugal force, then molten metal is streamed as a jet toward the liquid layer as it is allowed to move in the axial direction of the drum, and the molten metal is quenched and solidified, whereby a metal filament in coil form is produced. According to this method, it is possible to manufacture with ease a metal filament of circular cross section having various excellent characteristics and to achieve a substantially greater cooling rate than that possible where any earlier known method of the type is employed. It is known that this method is particularly suitable for use in manufacturing metal filaments from such materials as amorphous metals or microcrystal grain-containing metals.

However, the aforesaid rotating liquid spinning method is a batch method such that after a certain length of the metal filament is coiled round the inner periphery of the drum, the rotation of the drum is stopped for winding the metal filament on a winder, and this naturally means that the per-batch quantity of metal wire output is limited because of inevitable limitations imposed on the size of the plant equipment, and that time-consuming operations are required for preparation and after-treatment purposes. Therefore, the method has the disadvantage that its productivity is low, and indeed this has prevented the method from being adopted for industrialization.

A method of continuously manufacturing metal threads by a rotating liquid spinning process is disclosed in Japanese Published Unexamined Patent Application No. 57-70062. According to this method, a cooling liquid is introduced into an annular groove provided on the inner periphery of a hollow revolving roll, the cooling liquid being retained in the groove by the centrifugal force of the roll, and molten metal is streamed into the groove through a nozzle at the lower end of a crucible so that it is quenched to solidify into an amorphous metal coil, which in turn is guided outwardly by guiding means so that it is wound on a winder. For the purpose of said guiding means, compressed air streams are used, or alternatively a guide plate like a scraper is used by abutting it against the bottom of the groove so as to scrape the coil. One difficulty with this method is that as the coil is guided forward, the cooling water layer is disturbed by the action of the guide means. Another difficulty is that to make up for the loss of cooling liquid due to outward spattering thereof caused by the guide means, a continuous supply of cooling liquid is required, which is a cause of further turbulence of the cooling liquid layer.

It may be noted in this connection that in an attempt to produce metal filaments of 60–250 μm dia as sought to be obtained, the present inventors made experiments with the aforesaid continuous manufacturing method under various different sets of conditions only to find that the molten metal stream jetting from the nozzle was broken up before it was cooled to solidify in the cooling liquid layer; as such, no continuous metal wire could be obtained at all.

The object of the present invention is to provide a method and apparatus for continuously manufacturing metal filaments, which eliminates the aforesaid difficulties as previously experienced while making the best use of basic characteristics of the rotating liquid spinning method, and which permits high productivity and production at lower cost.

According to a first aspect of the invention, a method of continuously manufacturing a metal filament is provided wherein a cooling liquid layer is formed by centrifugal force on the inner periphery of a rotary drum in rotation, and wherein molten metal is streamed as a jet toward the cooling liquid layer so that it is quenched to solidify into a metal filament, the metal filament thus obtained being wound on a winder provided outside the rotating drum, the method being characterized in that before the metal filament is wound on the winder, (a) the front end portion of the metal filament is positioned on a pickup which rotates synchronously with the rotary drum and which, while in said synchronous rotation, is radially displaceable by cam means between a first radial position in the cooling liquid layer and a second radial position nearer to the rotation axis of the rotating drum than the first radial position, (b) the front end portion of the metal filament is attracted by attracting and holding means when the pickup reaches the second radial position, and (c) a following portion of the metal filament subsequently paid out from the rotating drum is drawn in and held by the attracting and holding means.

According to a second aspect of the invention, an apparatus for continuously manufacturing a metal filament is provided which comprises a rotary drum on the inner periphery of which a cooling liquid layer is formed by centrifugal force, drive means for driving the rotary drum at a specified rotational speed, means for supplying molten metal as a jet to the cooling liquid layer, and a winder provided outside the rotary drum for winding in a metal filament formed in the cooling liquid layer, said apparatus being characterized in that it further comprises (a) metal filament guidance means including a pickup rotatable synchronously with the rotating drum and cam means for displacing the pickup radially between a first radial position in the cooling liquid layer and a second radial position nearer to the rotation axis of the rotating drum than the first radial position, (b) timing control means for actuating jet feeder means to position the front end portion of the metal filament on the pickup when the pickup is in the first radial position and at a location roughly facing the jet feeder means, and (c) attracting and holding means for attracting the front end portion of the metal filament when the pickup reaches the second radial position and for drawing in and holding a following portion of the metal filament subsequently paid out from the rotary drum.

These and other features and advantages of the invention will be readily understood from the following description of embodiments thereof taken in conjunction with the accompanying drawings, in which.

Figure 4:
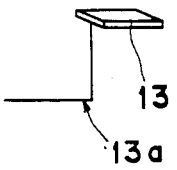
Figure 5:
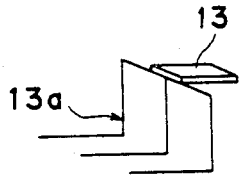
Figure 6:
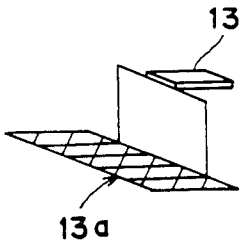
Figure 7:
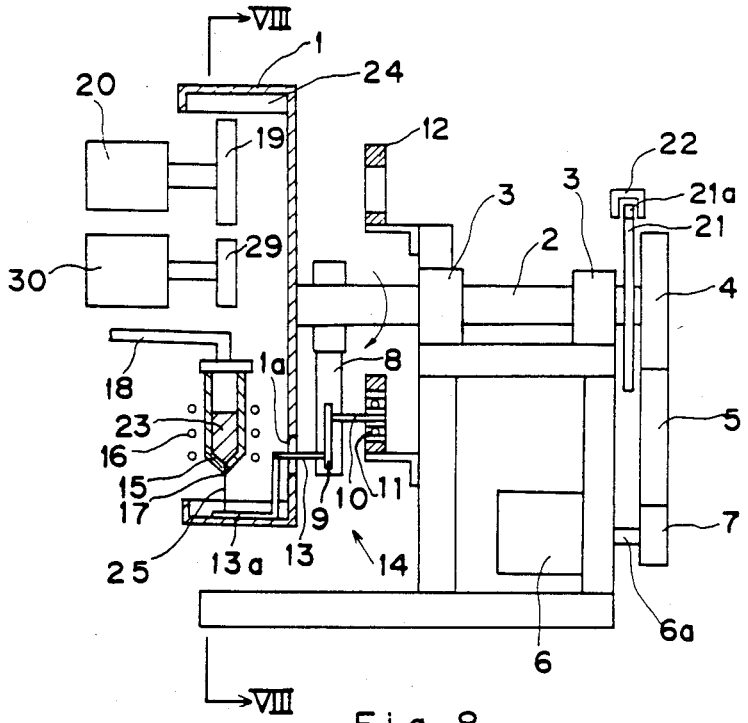
Figure 8:
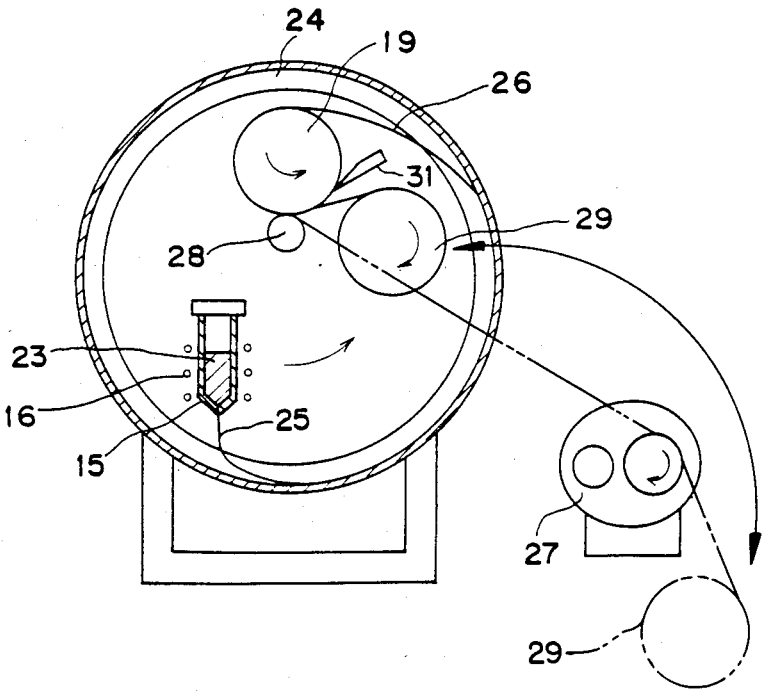

FIGS. 4 to 6, inclusive, are perspective views showing alternative constructions for the pickup;

FIG. 7 is a side view, partly in section, showing another form of continuous metal filament manufacturing apparatus embodying the invention; and FIG. 8 is a sectional view taken on line VIII—VIII in FIG. 7.

Figure 1:
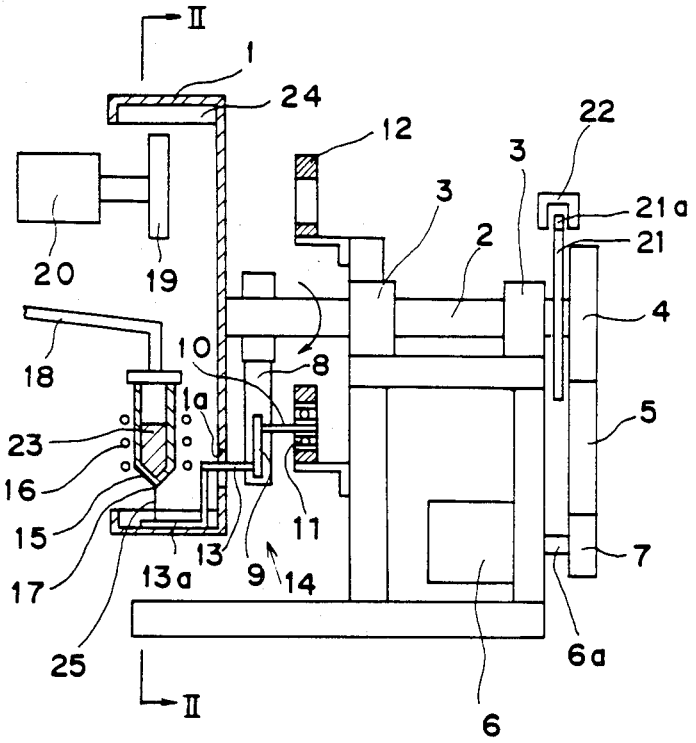
FIG. 1 is a side view, partly in section, showing an apparatus for continuously manufacturing metal filaments which represents one embodiment of the invention.
Figure 2:
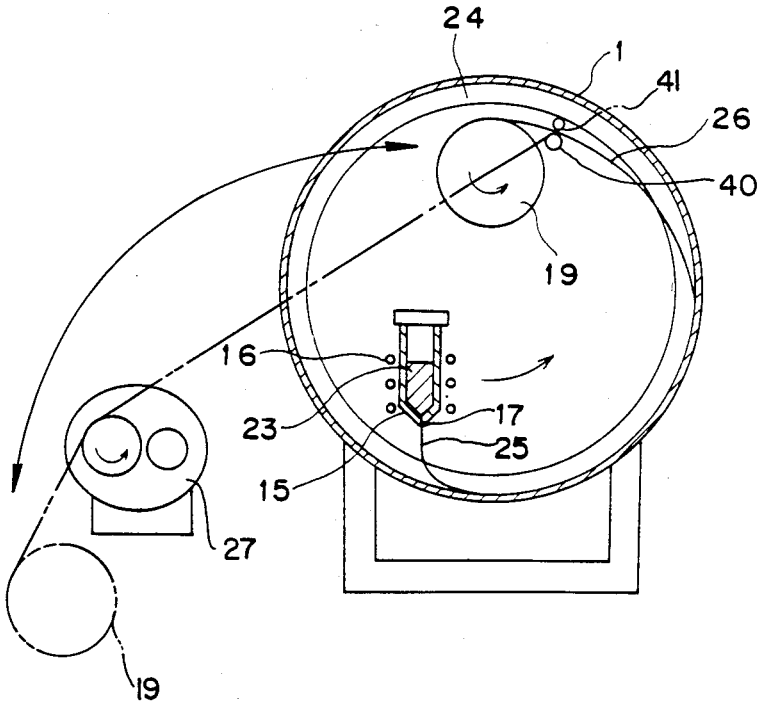
FIG. 2 is a sectional view taken on line II—II in FIG. 1.

In FIGS. 1 and 2, numeral 1 designates a rotary drum which is closed at one end and open at the other end. A rotary shaft 2 of the drum 1 is rotatably supported through a pair of bearings 3. A follower pulley 4 is fixed to the rotary shaft 2 and is connected through a timing belt 5 to a driving pulley 7 fixed to the output shaft 6*a* of a drive motor 6.

Figure 3:
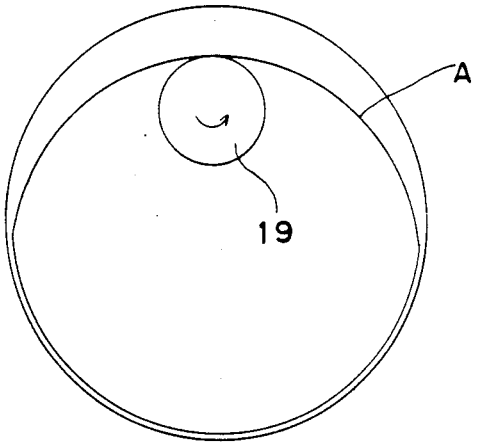
FIG. 3 is a schematic front view showing a movement path of a pickup in the apparatus.

A guide box 8 is also fixed to the rotary shaft 2, and in the guide box 8 a moving member 9 is radially movably housed relative to the drum 1. A coupling arm 10 extends from the moving member 9 in a direction away from the drum 1 and is guided by a cam ring 12 through a cam follower 11. A connecting bar 13 extends from the moving member 9 into the drum 1, and at one end of the connecting bar 13 there is provided a pickup 13*a*. On the closed-end side of the drum 1 there is formed a guide hole 1*a* extending in the radial direction of the drum 1 so as to allow the connecting bar 13 to move in the radial direction. Since the guide box 8 is fixed to the rotary shaft 2, the moving member 9, that is, the pick up 13*a* connected thereto is allowed to rotate synchronously with the drum 1, and during this rotation the pickup 13*a* is radially displaced following the cam profile of the cam ring 12. The cam profile of the cam ring 12 is set so as to permit the pickup 13*a* to follow a path A shown in FIG. 3. The pickup 13*a* may be comprised of a single L-shaped bent rod coupled to the connecting bar 13 as shown in FIG. 4. From the standpoint of performance reliability, however, it is preferable that the pickup 13*a* is comprised of a plurality of L-shaped bent rods spaced apart in the circumferential direction of the drum 1 as shown in FIG. 5, or of a net having a specified area as shown in FIG. 6. It is noted that the aforesaid guide box 8, moving member 9, coupling arm 10, cam follower 11, cam ring 12, connecting bar 13, and pickup 13*a* collectively constitute metal filament guidance means 14.

In the rotary drum 1 there is disposed a melting furnace 15 having heating means 16. The melting furnace 15 has at its lower end a nozzle 17 having a specified orifice diameter and is connected at its upper end to an inert gas supply source not shown through a pipeline 18. For the heating means 16, a high-frequency induction heating coil as shown is preferably used in order to permit fast metal melting in the melting furnace 15.

In the interior of the rotating drum 1 there is disposed a magnet roller 19 at a location substantially opposite from the melting furnace 15 relative to the center of the drum 1. The magnet roller 19 is driven by a drive motor 20.

On the rotating shaft 2 there is fixedly mounted a cam disk 21 having a marking protrusion 21*a* at one circumferential location thereon. When the marking protrusion 21*a* reaches a predetermined rotational position, its arrival there is detected by a proximity switch 22.

The continuous metal filament manufacturing apparatus, constructed as above described, operates in the following manner.

First, a predetermined quantity of a base alloy having a specified composition, as prepared in pellet form, is charged into the melting furnace 15 and heated by the heating means 16 to melt into molten metal 23. The molten metal 23 is held on standby for ready discharge from the nozzle 17 at the lower end of the melting furnace 15. Nextly, the rotary drum 1 is driven by the drive motor 6 at the predetermined rotational speed. A predetermined amount of cooling liquid is supplied from a feeder unit not shown to the drum 1, and an annular cooling liquid layer 24 is formed by centrifugal force as developed by the rotation of the drum 1.

After these preparatory steps are completed, the proximity switch 22 is put into operation. When the marking protrusion 21*a* on the cam disk 21 reaches the predetermined rotational position, the proximity switch so detects and actuates for example a valve (not shown) provided on the pipeline 18, to introduce an inert gas under a specified pressure into the melting furnace 15. Consequently, a jet 25 of molten metal is streamed from the nozzle 17 of the melting furnace 15. The pickup 13*a* is then at a position practically right under the nozzle 17 or slightly before such position. The molten metal jet 25 penetrates into the rotating cooling liquid layer 24 and is quenched and solidified into a metal thread 26. The front end portion of the metal thread 26 rides on the pickup 13*a* and moves along the path A (FIG. 3) given by the cam profile of the cam ring 12 until it reaches a location adjacent the outer periphery of the magnet roller 19 located in the vicinity of the cooling liquid layer 24. Accordingly, the front end portion of the metal wire 26 is attracted magnetically by the magnet roller 19 and is pulled round the outer periphery thereof. Before (on the upstream side of) the magnet roller 19 there are provided a stationary roller 40 and a nip roller 41 movable to a position shown in phantom line in FIG. 2 to contact face-to-face with the stationary roller 40. After the front end portion of the metal wire 26 is attracted to the magnet roller 19, said nip roller 41 moves to that position for contact with the stationary roller so as to nip and guide the metal filament 26. A constant torque motor is used as drive motor 20 for the magnet roller 19 to ensure that a constant tension is applied on the metal filament 26 so that no thread breakage or slackening will occur when the metal filament is wound round the magnet roller 19. Supposing that the discharge velocity of the jet 25 is $V_o$, the peripheral velocity of the rotary drum 1 is $V_1$, and the peripheral volocity of magnet roller 19 is $V_2$, the parameters are preferably set as follows:

$$V_1=(0.7-1.2)V_o$$

$$V_2=(1.0-1.2)V_o$$

The metal filament guidance means achieve its assigned task by allowing the front end portion of the metal filament 26 to be attracted to the magnet roller 19. Preferably, therefore, the cam ring 12 is made movable in the axial direction of the rotary drum 1 so that after the front end portion of the metal filament 26 is attracted to the magnet roller 19, the cam ring is so moved as to guide the cam follower 11 to a second cam track of circular configuration (not shown) provided on the cam ring 12, the pickup 13*a* being thus enabled to move along a path exactly along the inner periphery of the rotary drum 1. However, this is not of any particular necessity. Constant movement of the pickup 13*a* on the track A shown in FIG. 3 involves no substantial problem.

After a portion of the metal thread 26 is wound on the magnet roller 19, the roller 19, while in rotation, is withdrawn, together with the drive motor 20 therefor, from the rotary drum 1 by a mechanism not shown, and is moved slowly to a position adjacent the winder 27. The metal thread 26 extending between the magnet roller 19 and the rotary drum 1 (which thread, in actual operation, is guided by a plurality of rollers not shown) is cut by a cutter provided on an empty bobbin at the winder 27 in a manner known per se and is wound onto the bobbin. Subsequent winding is done directly from the drum 1 until the bobbin is fully wound. When winding on one bobbin is thus completed, winding the operation is automatically changed over to another bobbin at the winder 27 according to the known manner. The task of the magnet roller 19 ends when the metal filament 26 is drawn outside of the drum 1 and delivered to the winder 27. Therefore, after delivery of the metal filament 26 to the winder 27, the magnet roller 19 is held on standby outside.

In the above described embodiment, the magnet roller 19 is employed for the purpose of catching the front end portion of metal filament 26. Alternatively, the front end portion of the metal filament 26 guided by the pickup 13*a* to the outside of the cooling liquid layer 24 may be sucked into suction means. In this case, however, measures must be taken to ensure that no disturbance is caused to the stability of the cooling liquid layer in the course of the suction operation by the suction means.

In another embodiment shown in FIGS. 7 and 8, a nip roller 28 is disposed at a fixed position in opposed relation to a first magnet roller 19 (which corresponds to the magnet roller 19 in FIGS. 1 and 2) driven by a drive motor 20 and having a fixed position, and a second magnet roller 29 driven by a drive motor 30 is disposed beyond the first magnet roller 19. The second magnet roller 29, together with the drive means 30 therefor, is movable outwardly of the rotary drum 30. A scraper 31 is provided in opposed relation to the first magnet roller 19. Other features of the embodiment are substantially the same as those in FIGS. 1 and 2.

According to this arrangement, when the front end portion of the metal thread 26 is attracted to the first magnet roller 19 in the same manner as in the embodiment of FIGS. 1 and 2, said end portion passes between the first magnet roller 19 and the nip roller 28 to reach the scraper 31. By the action of this scraper 31, the front end portion of the metal filament 26 is peeled off the first magnet roller 19 and is attracted to the second magnet roller 29 so that it is wound round the roller 29. Subsequently, the second magnet roller 29 is taken outside of the rotating drum 1 and moved to the vicinity of a winder 27, so that in the same manner as in the first embodiment, the metal filament 26 is wound on the winder 27.

In this embodiment, the drive motor 30 for the second magnet roller 29 is comprised of a constant torque motor, so that the motor speed is adjusted to ensure that the tension exerted on the metal filament 26 is kept constant. The drive motor 20 for the first magnet roller 19 need not have an auto-tension function. Since the stationary nip roller 28 is disposed in face-to-face contact relation with the first magnet roller 19, which is stationary, it is not necessary to provide, in contrast to the first embodiment, a combination of a stationary roller and a movable nip roller before (on the upstream side of) first magnet roller 19.

In the above described two embodiments, if a metal filament 26 is to be continuously manufactured over a long period of time, one or more additional melting furnaces may be arranged outside the drum 1 to supply molten metal or alloy pellets continuously through a pipeline into the melting furnace disposed in the drum 1.

Types of metals which can be used for the purpose of the invention include pure elemental metals, elemental metals containing slight amounts of impurities, and all kinds of alloys. More specifically, alloys which provide excellent characteristics, when quenched and solidified, are preferred. For example, alloys which can form an amorphous or non-equilibrium crystal phase are most preferred. Examples of alloys which can form amorphous phase are given in various publications including, for example, "Science" No. 8, 1978, pp 62–72, The Japan Institute of Metals Bulletin Vol. 15, No. 3, 1976, pp 151–206, "Metal", Dec. 1, 1971, pp 73–78, Japanese Published Unexamined Patent Application No. 49-91014, Japanese Published Unexamined Patent Application No. 50-101215, Japanese Published Unexamined Patent Application No. 49-135820, Japanese Published Unexamined Patent Application No. 51-3312, Japanese Published Unexamined Patent Application No. 51-4017, Japanese Patent Unexamined Patent Application No. 51-4018, Japanese Published Unexamined Patent Application No. 51-4019, Japanese Published Unexamined Patent Application No. 51-65012, Japanese Published Unexamined Patent Application No. 51-73920, Japanese Published Unexamined Patent Application No. 51-73923, Japanese Published Unexamined Patent Application No. 51-78705, Japanese Published Unexamined Patent Application No. 51-79613, Japanese Published Unexamined Patent Application No. 52-5620, Japanese Published Unexamined Patent Application No. 52-114421, and Japanese Published Unexamined Patent Application No. 54-99035. Among various kinds of alloys given in these publications, examples of those having excellent amorphous phase forming characteristics and suitable for practical application are typically Fe-Si-B, Fe-P-C, Fe-P-B, Co-Si-B, and Ni-Si-B. Needless to say, various suitable alloys can be selected from metal-semi-metal combinations and metal-metal combinations. Further, it is possible to obtain alloy combinations having excellent characteristics which known crystalline metals cannot provide by advantageously incorporating desirable characteristics of known alloy compositions. Examples of alloys which can form non-equilibrium crystal phase include, for example, Fe-Cr-Al alloys and Fe-Al-C alloys described in "Iron & Steel", vol. 66 (1980), No. 3, pp 382–389, The Japan Institute of Metals Journal, vol 44, No. 3, 1980, pp 245–254, "Transaction Of The Japan Institute of Metals", vol 20, No. 8, August 1979, pp 468–471, and The Japan Institute of Metals Autumn Convention General Lecture Summary (October 1979), pp 350, 351, and also Mn-Al-C alloys, Fe-Cr-Al alloys, and Fe-Mn-Al-C alloys described in The Japan Institute of Metals Autumn Convention Lecture Summary (November 1981), pp 423–425.

Nextly, examples based on experiments made by employing the apparatus shown in FIGS. 1 and 2 will be explained.

EXAMPLE

Alloy pellets having a composition of $Fe_{75}Si_{10}B_{15}$ (where subscript denotes atom%) were continuously melted at 1320° C. in the melting furnace 15. The molten metal was continuously jetted out from the nozzle 17 having a diameter of 0.15 mm under an inert gas pressure of 4.3 kg f/cm$^2$. Water of 5° C. was used as cooling liquid. The rotary drum used had an inner diameter of 500 mm. The cooling liquid layer formed was 30 mm wide and 15 mm deep. The rotational speed was 350 rpm. The magnet roller 19 was a permanent magnet having a magnetism of 3300 gauss and on outer diameter of 150 mm. The rotational speed of the roller was set at 1165 rpm. The pickup 13*a* was constructed of three rods disposed at 75 mm intervals and having a diameter of 1.6 mm and a length of 50 mm, each bent to L-shape as shown in FIG. 1. After the start of molten metal jetting, the front end portion of metal filament 26 was successfully guided to the surface of the magnet roller 19. Thus, the metal filament 26 was successfully wound round the magnet roller 19. The magnet roller 19 was moved to the vicinity of the winder 27 located outside the rotary drum 1, and the metal filament was delivered to the winder 27 and wound thereon. During the period of from the start of molten metal jetting and to the start of winding by the winder 27, the metal filament 26 ran continuously without breakage. Winding was continued and bobbin change was repeated at the winder 27. Twenty packages, each 1 kg on bobbin were obtained continuously.

What is claimed is:

1. A method of continuously manufacturing a metal filament wherein a cooling liquid layer is formed by centrifugal force on the inner periphery of a rotary drum in rotation, and wherein molten metal is streamed as a jet toward the cooling liquid layer so that it is quenched to solidify into a metal filament, the metal filament thus obtained being wound on a winder provided outside the rotary drum, characterized in that the method comprises, prior to the metal filament being wound on the winder, (a) positioning the front end portion of the metal filament on a pickup which rotates synchronously with the rotary drum and which, while in said synchronous rotation, is radially displaceable by cam means between a first radial position in the cooling liquid layer and a second radial position nearer to the rotation axis of the rotating drum than the first radial position, (b) attracting the front end portion of the metal filament by attracting and holding means when the pickup reaches the second radial position, and (c) causing the attracting and holding means to draw in and hold a following portion of the metal filament subsequently paid out from the rotary drum.

2. An apparatus for continuously manufacturing a metal filament comprising a rotary drum on the inner periphery of which a cooling liquid layer is to be formed by centrifugal force, drive means for driving the rotary drum at a specified rotational speed, means for supplying molten metal as a jet to the cooling liquid layer, and a winder provided outside the rotary drum for winding in a metal filament formed in the cooling liquid layer, characterized in that the apparatus further comprises (a) metal filament guidance means including a pickup rotatable synchronously with the rotary drum and cam means for displacing the pickup radially between a first radial position in the cooling liquid layer and a second radial position nearer to the rotation axis of the rotating drum than the first radial position, (b) timing control means for actuating jet feeder means to position the front end portion of the metal filament on the pickup when the pickup is in the first radial position and at a location virtually facing the jet feeder means, and (c) attracting and holding means for attracting the front end portion of the metal filament when the pickup reaches the second radial position and for drawing in and holding a following portion of the metal filament subsequently paid out from the rotary drum.

3. An apparatus as set forth in claim 2 wherein the attracting and holding means comprises a magnet roller movable between a position adjacent to the cooling liquid layer in the rotary drum and a position adjacent to the winder outside the rotary drum and adapted to be driven by a drive motor.

4. An apparatus as set forth in claim 3 wherein the drive motor for driving the magnet roller is a constant torque motor.

5. An apparatus as set forth in claim 2 wherein the attracting and holding means comprises a first magnet roller driven by a drive motor at a fixed position adjacent to the cooling liquid layer in the rotary drum, a nip roller disposed in face-to-face relation to the first magnet roller for nipping and guiding the metal filament in conjunction with the first magnet roller, a second magnet roller movable between a position beyond the first magnet roller within the rotating drum and a position adjacent to the winder outside the rotating drum and driven by a drive motor, and a scraper disposed in face-to-face relation to the first magnet roller at a position beyond the nip roller for releasing the front end portion of the metal filament from the first magnet roller so as to direct it toward the second magnet roller.

6. An apparatus as set forth in claim 5 wherein the drive motor for driving the second magnet roller is a constant torque motor.

7. An apparatus as set forth in claim 2 wherein the metal filament guidance means comprises a guide box rotatable synchronously with the rotary drum, a moving member which is movable within the guide box in the radial direction of the rotary drum, a coupling arm for coupling the moving member to cam means through the cam follower, and a connecting bar for connecting the moving member and the pickup to each other.

8. An apparatus as set forth in claim 2 wherein the cam means are in the form of a cam ring.

9. An apparatus as set forth in claim 2 wherein the pickup is comprised of a single generally L-shaped bent rod.

10. An apparatus as set forth in claim 2 wherein the pickup is comprised of a plurality of generally L-shaped bent rods.

11. An apparatus as set forth in claim 2 wherein the pickup comprises a net of a specified area.

12. An apparatus as set forth in claim 2 wherein the timing control means comprises a cam disk rotatable synchronously with the rotary drum and having a marking protrusion at one circumferential location, and a proximity switch which detects the arrival, at a specified rotational position, of the marking protrusion to actuate the jet feeder means.

* * * * *